United States Patent [19]

Puett

[11] Patent Number: 5,069,018

[45] Date of Patent: Dec. 3, 1991

[54] OPEN LOADING SKIN PACKAGING MACHINE

[75] Inventor: Cecil E. Puett, Las Vegas, Nev.

[73] Assignee: Sunclipse, Inc., Montebello, Calif.

[21] Appl. No.: 576,656

[22] Filed: Aug. 31, 1990

[51] Int. Cl.[5] ..... B65B 11/52

[52] U.S. Cl. ..... 53/427; 53/509

[58] Field of Search ..... 53/141, 390, 427, 432, 53/433, 509, 510, 511

[56] References Cited

U.S. PATENT DOCUMENTS

| | | | |
|---|---|---|---|
| 2,976,658 | 3/1961 | Kostur | 53/509 |
| 3,276,633 | 8/1966 | Goodman | 53/427 |
| 3,534,521 | 10/1970 | Rorer | 53/427 |
| 3,745,739 | 7/1973 | Madsen et al. | 53/427 |
| 3,988,093 | 10/1976 | Birchenough | 53/509 X |
| 4,400,612 | 8/1983 | Lee | 53/509 X |
| 4,418,511 | 12/1983 | Collin | 52/427 |
| 4,480,425 | 11/1984 | Furukawa | 53/509 |
| 4,656,816 | 4/1987 | Watts | 53/427 X |

*Primary Examiner*—John Sipos

*Assistant Examiner*—Linda B. Johnson

*Attorney, Agent, or Firm*—Beehler & Pavitt

[57] ABSTRACT

A vacuum packaging apparatus for packaging a product between a plastic film and a backing board includes a base which has a stationary heating hood. A packaging table is mounted on the base and offset from the hood to extend laterally and outwardly from the hood. A sealing frame is mounted on the base for holding a sheet of wrapping material. First and second elongated arms are pivotally attached to both the base and the frame to connect the frame to the base. The arms may be pivoted to move the frame from a sealing position, wherein the frame is positioned adjacent the packaging table, to a heating position, wherein the frame is positioned adjacent the heating hood to heat the sheet. A vacuum motor is mounted in the base beneath under the packaging table. When the sealing frame is lowered to the sealing position to place the heated sheet over the board, a vacuum is drawn against the backing board to seal the heated sheet over the product onto the backing board.

15 Claims, 2 Drawing Sheets

OPEN LOADING SKIN PACKAGING MACHINE

FIELD OF THE INVENTION

This invention relates generally to apparatus for packaging various items. More specifically, the invention relates to a vacuum packaging machine for securing wrapping material over a product which has been placed on a backing board. The present invention is particularly, though not exclusively, useful for shrink wrapping a clear plastic film onto a printed cardboard backing card to enclose and package a product between the plastic film and the backing card.

BACKGROUND OF THE INVENTION

There are many types of vacuum packaging devices which use a vacuum to draw a sheet of plastic film onto a backing card for packaging a product. Conventional vacuum packaging machines typically include a fixed platen or table on which a cardboard backing card is placed. A product or products are positioned by an operator on the backing card, and a sheet of plastic film is placed over the product to cover the product and the card. The sheet is typically heated prior to or during its placement over the product and the card, and after such placement, a vacuum is drawn from beneath the card to remove air from between the card and the film to seal the film over the product onto the card. The sealed package containing the product is then cut to the desired size.

There are several disadvantages, however, associated with use of conventional vacuum packaging machines. For example, in order to provide the necessary heating of the wrapping film, some conventional machines use a movable heating hood assembly. Such movable heating hood assemblies are typically constructed to move horizontally back and forth over the work area where the film is to be sealed over the product and card. To avoid burning the operator, movable hoods are typically designed to generate heat only after they are moved by the operator into position. Also, conventional heating hoods use electric rods or bulb heating elements which take time to heat and/or cool. The steps of moving the hood into and out of position, coupled with the heating and cooling times, add unwanted time to the packaging process, which results in lower productivity.

Other conventional packaging apparatus which use a stationary heating hood require that the backing board be placed by an operator onto the platen, which is fixed in position under the heating hood in the packaging work area. This requires that the operator reach into the packaging work area to place the backing card in position, and to reach into the work area to position the product or products in proper orientation onto the backing board. This placing and positioning of the product onto the backing board cannot, however, occur during the packaging operation. Instead, the operator must wait until the packaging operation is completed and the completed board is removed, before the operator can begin to place the next board on the platen and position products on the board. This tends to slow the packaging operation. Also, because the placing and positioning of the product occurs under the heating hood, there is an increased chance that the operator may inadvertently touch the heating hood while it is still hot. In such circumstances, there is an increased danger that the operator may be burned.

In light of the above, the present invention recognizes the need for a vacuum packaging machine that is safe and convenient to operate. The present invention also recognizes the desire to increase packaging productivity. The present invention further recognizes the need for a vacuum packaging machine which is designed to provide greater stability and durability in use.

Accordingly, it is an object of the present invention to provide an apparatus which vacuum packages wrapping material about a product and has an open work area to facilitate loading product on backing board and removing the packaged product from the apparatus. It is another object of the present invention to provide a packaging apparatus which operates in a safe and reliable manner. It is yet another object of the present invention to provide a packaging apparatus which is relatively durable and which can be easily serviced. Still another object of the present invention is to provide a packaging machine which is relatively simple and convenient to operate, and which is cost-effective in its manufacture.

SUMMARY OF THE INVENTION

A preferred embodiment of the vacuum packaging machine for vacuum sealing a plastic film over a product to hold the product securely on a backing board includes a base which has a stationary heating hood. A rectangular stationary packaging table is also mounted on the base, and extends laterally outwardly from beneath the heating hood, i.e., the heating hood is recessed from the packaging table. Stated differently, the packaging table is distanced and laterally offset from the heating hood.

A movable rectangular sealing frame is mounted on the base beneath the heating hood and over the packaging table. The sealing frame includes a top frame portion and a bottom frame portion which are hingedly connected together. More particularly, the top frame portion is hingedly movable, between an open position and a closed position relative to the bottom frame portion. In the open position, the top frame portion is pivoted away from the bottom frame portion to allow loading of a sheet of plastic film between the top frame portion and the bottom frame portion. Also, movement of the top frame portion into the open position allows removal of the final packaged product from the machine. When the top frame portion is moved into the closed position, the top frame portion is placed against the bottom frame portion to hold the plastic sheet taut between the top and bottom frame portions.

The sealing frame is connected to the base and can be moved to a heating position, wherein the sealing frame (and plastic sheet held by the frame) are positioned adjacent the heating hood. The sealing frame can also be moved to a sealing position, wherein the sealing frame (and plastic sheet) are positioned adjacent the packaging table. Stated differently, the sealing frame has a raised position, wherein the frame is directly beneath the heating hood, and a lowered position, wherein the frame is directly above the packaging table.

To move the sealing frame, a pair of elongated lift arms and a pair of elongated idler arms connect the sealing frame to the base. More specifically, a first idler arm and a first lift arm are parallel to each other and are each pivotally connected to both a first side of the sealing frame and to the base. Similarly, a second idler arm and second lift arm are parallel to each other and are each pivotally connected to both a second side of the sealing frame opposite the first side and to the base. A lift bar interconnects the two lift arms, and an air-driven cylinder is mounted on the base beneath the packaging table to urge against the lift bar and thereby move the lift bar, lift arms, and sealing frame.

A vacuum motor is also mounted on the base beneath the packaging table. The vacuum motor can be activated to establish a vacuum seal of the film around the products and onto the backing board which was previously placed on the packaging table.

A rotatable roll of plastic sheet material can be mounted on the base adjacent any side of the base below the packaging table to feed the plastic sheet onto the sealing frame when the sealing frame is in its sealing position. With the roll of plastic sheet material so positioned, the plastic sheet material can be pulled by the operator from the roll into the sealing frame.

The method of vacuum packaging according to the present invention is started by placing a sheet of plastic between the top and bottom portions of the sealing frame. Then, the top frame portion is moved to the closed position to hold the sheet in the sealing frame. The sealing frame which holds the plastic sheet is raised to the heating, i.e., recessed, position directly beneath the recessed heating hood. Next, a backing board is placed onto the packaging table and product is placed onto the backing board.

After the sealing frame has held the sheet of plastic in the heating position for a sufficient time, the heated sheet is lowered laterally away from the heating hood and onto the backing board (and product) which are on the packaging table. The vacuum pump is activated and, consequently, a vacuum is drawn to seal the heated plastic sheet over the product and thus package the product onto the backing board.

Once the product has been packaged onto the board, the sealing frame is opened to remove the product. Removal of the packaged product also pulls a new portion of the plastic sheet into the sealing frame. The process is then repeated as desired.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
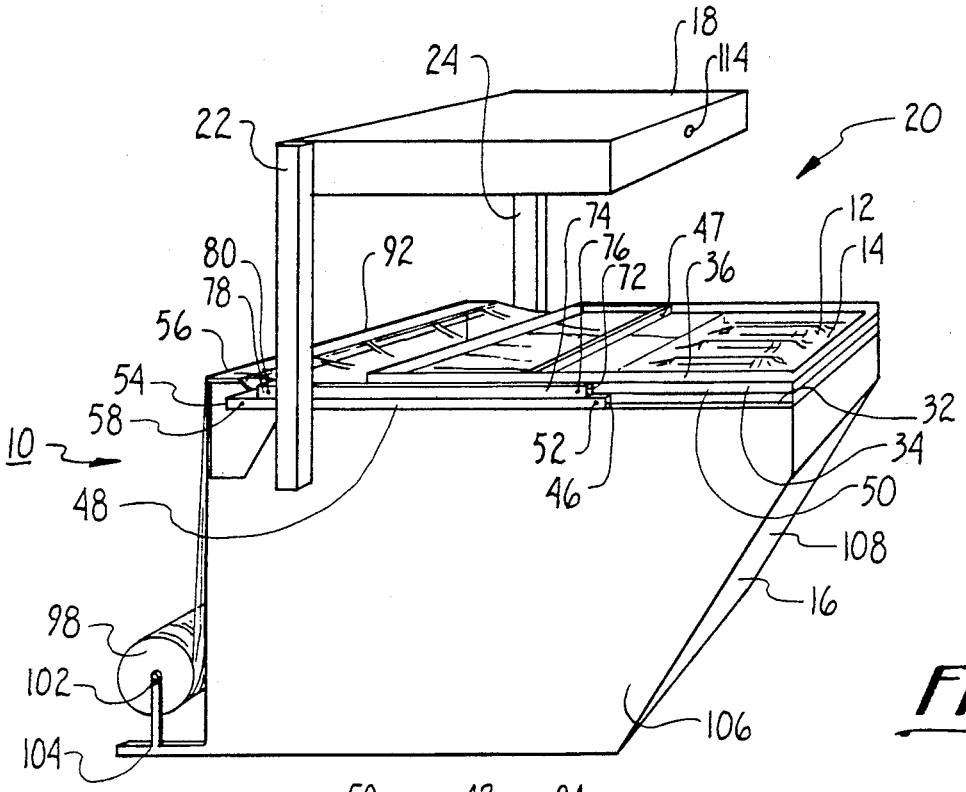
FIG. 1 is a perspective view of the novel vacuum packaging apparatus of the present invention, showing the sealing frame in the sealing position and the top frame portion in the closed position.
Figure 2:
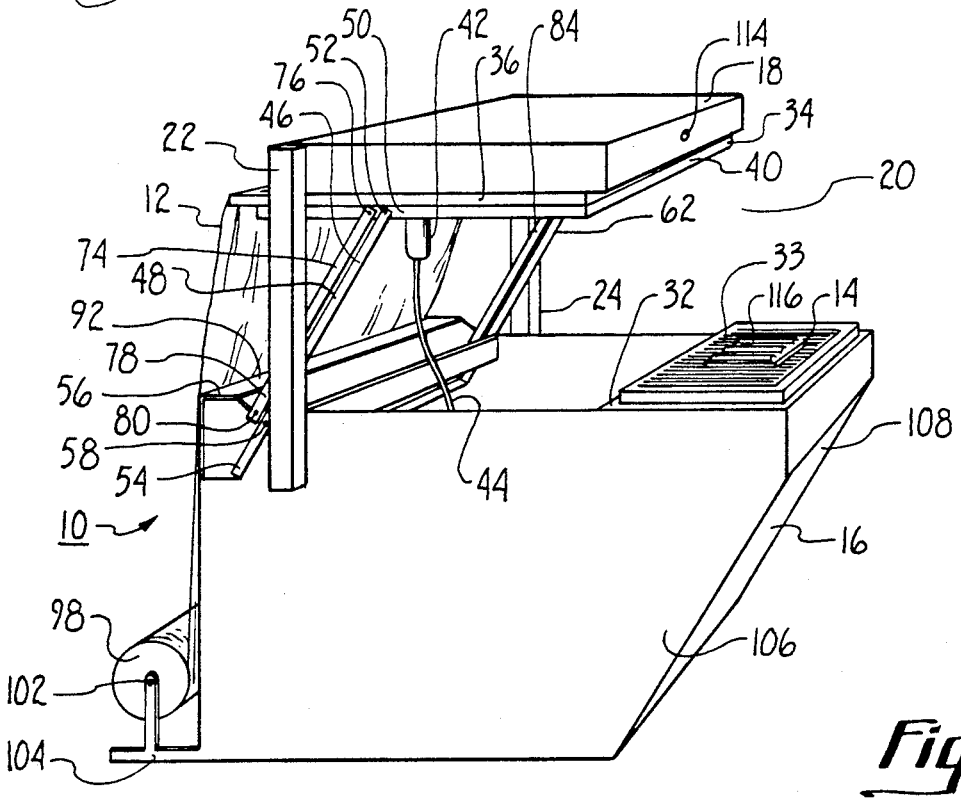
FIG. 2 is a perspective view of the novel vacuum packaging apparatus of the present invention, showing the sealing frame in the heating position.

Referring initially to FIGS. 1 and 2, there is shown a vacuum packaging apparatus, generally designated 10, for packaging a product between a plastic sheet 12 and a backing board 14. It is to be appreciated that plastic sheet 12 can be made of plastic film, for example a suitable nonporous commercially available film such as Surlyn, PVC, Polyethylene, Barex or Visqueen. As shown in FIGS. 1 and 2, apparatus 10 includes a base 16, which has a stationary heating hood 18. Heating hood 18 is fixedly supported above an open packaging work area 20 by hood support members 22, 24. Hood support members 22, 24 are fixedly attached to base 16 and support heating hood 18 at a predetermined distance above the work area 18 as substantially shown in FIG. 1. Hood support members 22, 24 may be welded or bolted to hood 18 and base 16. For purposes of the present invention, base 16, hood support members 20, 22, and heating hood 18 may advantageously be made of a strong and durable material, such as steel.

Figure 4:
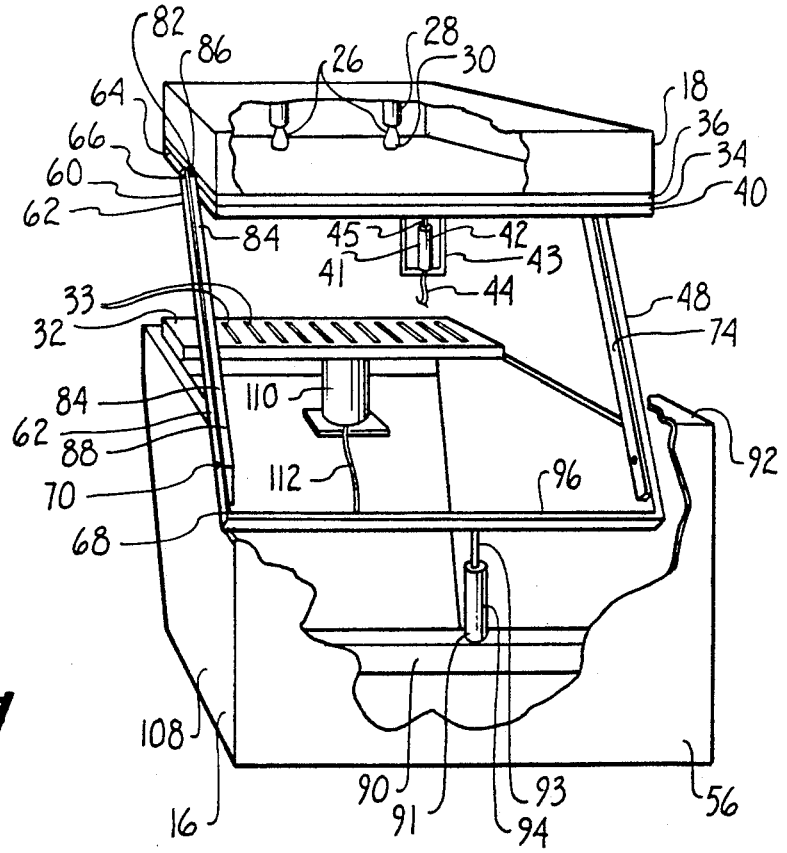
FIG. 4 is a perspective view of the novel vacuum packaging apparatus of the present invention, showing the sealing frame in the heating position, with the hood supports removed and portions of the heating hood and base cut away for clarity.

Referring briefly to FIG. 4, an array of heating elements 26 is shown, with each element 26 being mounted in heating hood 18. In the preferred embodiment shown, each heating element 26 has a ceramic socket 28 and one-piece wire-wrapped ceramic cone 30. Each cone 30 is screwed into a respective socket 28, and may be individually removed or replaced. To obtain uniform heating, the heating elements 26 are wired in series to a power supply (not shown) which provides power to the individual sockets 28.

Referring back to FIGS. 1 and 2, it can be seen that a rectangular packaging table 32 is fixedly mounted on base 16, beneath heating hood 18. Table 32 is designed to hold backing board 14, which can be paper, cardboard, or some similar porous packaging material well known in the art. As shown best in FIG. 2, table 32 is formed with a plurality of vacuum slits, or ports, 33. Importantly, table 32 is distanced and extends laterally outwardly from beneath heating hood 18 in a plane which is substantially parallel to the plane of heating hood 18. Stated differently, table 32 is laterally offset from heating hood 18. Accordingly, access to work area 20 is substantially unimpeded by heating hood 18. Consequently, safety during operation is enhanced because the operator is not required to reach directly underneath heating hood 18 to position backing board 14 onto table 32, or to remove backing board 14 from table 32.

Figure 3:
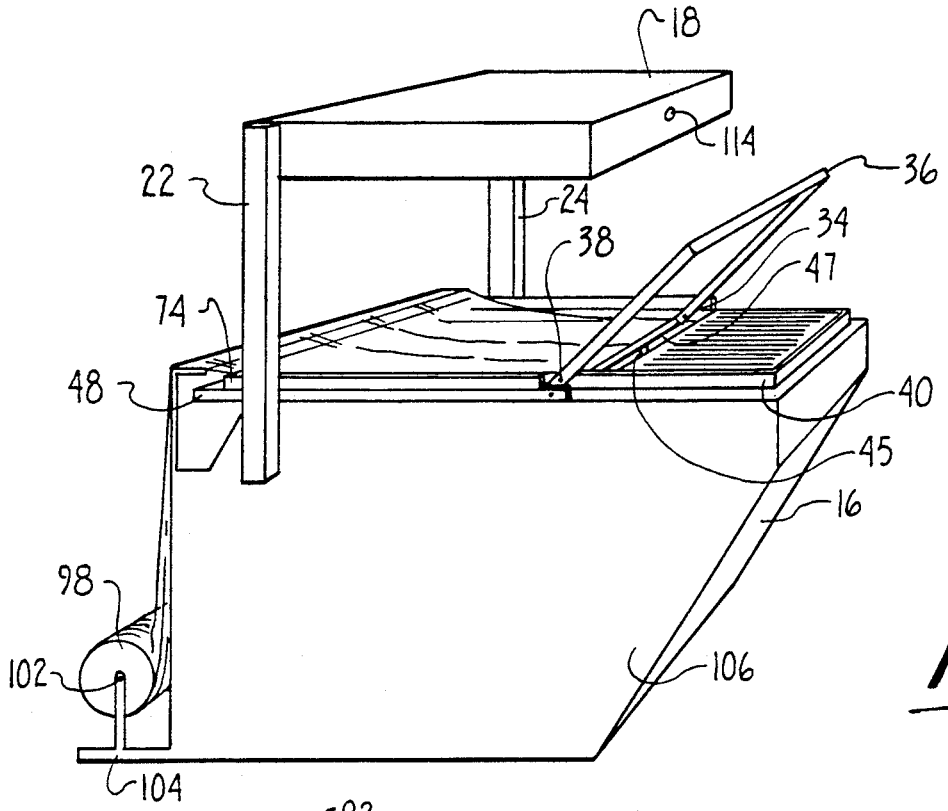
FIG. 3 is a perspective view of the novel vacuum packaging apparatus of the present invention, showing the sealing frame in the sealing position and the top frame portion in the open position.

As further shown in FIGS. 1 and 3, a rectangular sealing frame 34 is mounted to base 16 between packaging table 32 and heating hood 18. Sealing frame 34 has a top frame portion 36 which is hingedly connected at a pivot point 38 to a bottom frame portion 40, as best seen in FIG. 3. Top frame portion 36 is movable from a open position, shown in FIG. 3, to a closed position, shown in FIGS. 1, 2, and 4. When top frame portion 36 is in its open position, a section of sheet 12 may be positioned between top frame portion 36 and bottom frame portion 40. On the other hand, when top frame portion 36 is in its closed position, the section of sheet 12 which is positioned between top frame portion 36 and bottom frame portion 40 can be held taut across closed sealing frame 34.

As best seen in cross-reference to FIGS. 3 and 4, a pneumatic cylinder 42 is fixedly attached to bottom frame portion 40 and top frame portion 36 to move top frame portion 36 into its respective open and closed positions. More specifically, as shown in FIG. 4, housing 41 of cylinder 42 is fixedly attached to a bracket 43, which is in turn fixedly attached to bottom frame portion 40. Piston 45 of cylinder 42 is fixedly attached to crossbar 47, shown in FIG. 3, which is integrally formed with top frame portion 36. Accordingly, piston 45 can be activated to urge against or pull crossbar 47 of top frame portion 36 to move frame 34 into the closed or open position, respectively. Cylinder 42 is connected to appropriate hydraulic control equipment (not shown) through a line 44.

Importantly, sealing frame 34 is movable between a heating position, shown in FIG. 2, and a sealing position, shown in FIG. 1. More particularly, sealing frame 34 can be raised to a heating position wherein sealing frame 34 is adjacent (i.e., directly below) heating hood 18, as shown in FIG. 2. Also, sealing frame 34 can be lowered downwardly and laterally outwardly from heating hood 18 to a sealing position wherein sealing frame 34 is adjacent (i.e., directly above) packaging table 32, as shown in FIG. 1.

In accordance with the present invention, sealing frame 34 is moved into its sealing and heating positions by four pivotal arms. More specifically, referring back to FIGS. 1 and 2, a first end 46 of a first elongated lift arm 48 is pivotally attached to a first side edge 50 of bottom frame portion 40 at a pivot point 52. Further, second end 54 of first lift arm 48 is pivotally attached to a covered rear cabinet 56 of base 16 at a pivot point 58. Additionally, as shown best in FIG. 4, a first end 60 of a second elongated lift arm 62 is pivotally attached to a second side edge 64 of bottom frame portion 40 at a pivot point 66. Moreover, second end 68 of second lift arm 62 is pivotally attached to cabinet 56 of base 16 at a pivot point 70.

Importantly, two elongated idler arms 74, 84 interconnect sealing frame 34 and rear cabinet 56 of base 16 and cooperate with lift arms 48, 62 to maintain bottom frame portion 40 in a substantially horizontal orientation, i.e., parallel to packaging table 32. More particularly, referring to FIGS. 1 and 2, a first end 72 of first idler arm 74 is pivotally attached to first side edge 50 of bottom frame portion 40 at a pivot point 76. The second end 78 of first idler arm 74 is pivotally attached to rear cabinet 56 at a pivot point 80. Additionally, as best seen in FIG. 4, the first end 82 of a second idler arm 84 is pivotally attached to second side edge 64 of bottom frame portion 40 at a pivot point 86. Moreover, the second end 88 of second idler arm 84 is pivotally attached to rear cabinet 56 at a pivot point (not shown) near pivot point 70 of second lift arm 62. As shown in FIGS. 2 and 4, first idler arm 74 is parallel with first lift arm 48, while second idler arm 84 is parallel with second lift arm 62. Consequently, the lift arms 48, 62 cooperate with the idler arms 74, 84 to maintain bottom frame portion 40 of sealing frame 34 substantially parallel to upper surface 92 of rear cabinet 56 (and, hence, parallel to packaging table 32).

To move the arms 48, 62, the housing 91 of a pneumatic cylinder 94 is fixedly attached to mount 90 of base 16, as shown in FIG. 4. Also, piston 93 of cylinder 94 is fixedly attached to a load bar 96. As shown in FIG. 4, load bar 96 is fixedly attached to first lift arm 48 and second lift arm 62. Consequently, piston 93 of cylinder 94 is operable to urge against or pull load bar 96 to respectively lower or raise sealing frame 34.

Additionally, FIGS. 1, 2, and 3 show that plastic sheet 12 is fed from a roll 98 which is rotatably held on a shaft 102. Shaft 102 can be attached to a mounting bracket 104, and mounting bracket 104 in turn fixedly attached to base 16. For example, bracket 104 can be formed integrally with base 16 or welded to base 16. While the Figures show that mounting bracket 104 (and, hence, roll 98) is attached to rear cabinet 56 of base 16, it is to be understood that roll 98 may alternatively be mounted to side 106 or 108 of base 16, as appropriate for the particular direction of production flow of apparatus 10. In any case, the operator of apparatus 10 can conveniently position sections of sheet 12 between top frame portion 36 and bottom frame portion 40 by pulling on sheet 12.

Finally, FIG. 4 shows that a vacuum pump 110 is mounted on base 16 and is connected in fluid communication by any suitable means to the vacuum ports 33. Electrical power is supplied to vacuum pump 110 through electrical line 112.

OPERATION

In the operation of apparatus 10, sealing frame 34 is initially moved to its sealing position and top frame portion 36 is moved to its open position, as shown in FIG. 3. Then the operator (not shown) of apparatus 10 can position a section of sheet 12 between top frame portion 36 and bottom frame portion 40. The operator can then depress a cycle start button 114 to start a packaging cycle. Subsequent to depressing button 114, cylinder 42 is activated to move top frame portion 36 to its closed position to hold sheet 12 taut between top frame portion 36 and bottom frame portion 40. Also, cylinder 94 is activated to raise sealing frame 34 to its heating position, as shown in FIG. 2. Heating elements 26 are activated to heat the portion ©f plastic sheet 12 which is held by sealing frame 34 for a sufficient time to make the heated portion of sheet 12 sufficiently pliant to allow it to be subsequently vacuum sealed properly onto board 14. In the preferred embodiment, sheet 12 is held approximately two (2) inches from heating hood 18 for an interval of approximately twelve (12) seconds.

Simultaneously with the heating of plastic sheet 12, the operator of apparatus 10 places backing board 14 onto packaging table 32, as shown in FIG. 2. The operator can place one or more products 116, shown in FIG. 2, into desired orientations on board 14. After the heating interval, cylinder 94 is activated to lower sealing frame 34 to a sealing position as shown in FIG. 1. Once sealing frame 34 has been lowered into the sealing position, sealing frame 34 fits onto packaging table 32 to establish a sealed engagement over board 14 (and the products 116 placed thereon). Once frame 34 is in position, vacuum pump 110 is activated to remove air from between sheet 12 and board 14 through vacuum ports 33. This vacuum seals the heated sheet 12 over the products 116 and onto board 14. Consequently, product 116 is packaged onto board 14.

Next, cylinder 42 is activated to move top frame portion 36 to the open position, and the completed vacuum packaged products 116 (and board 14) are then removed by the operator from packaging table 32. It is to be appreciated that because sheet 12 is still secured to board 14, by removing the board 14 from frame 32, the operator pulls a new section of sheet 12 from roll 98 into position across bottom frame portion 40. Top frame portion 36 is then lowered by the operator onto bottom frame portion 40 to hold the new section of sheet 12 in sealing frame 32 for the next vacuum packaging operation. The above-described process is repeated as desired.

While the particular vacuum packaging machine as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

What is claimed is:

1. A vacuum packaging apparatus for sealing product between a sheet of wrapping material and a backing board, which comprises:

a base having a stationary heating hood;

a packaging table stationarily mounted on said base for supporting said backing board, said packaging table being distanced from and beneath said hood and located laterally outwardly therefrom;

a sealing frame movably mounted on said base and having means for holding said sheet of wrapping material;

means for moving said sealing frame along an arc between a first position wherein said sealing frame is positioned adjacent said heating hood for heating said sheet, and a second position wherein said sealing frame is positioned with said sheet over said backing board and adjacent said packaging table; and vacuum means mounted on said base for drawing a vacuum through said backing board when said sealing frame is in said second position to seal said heated sheet against said backing board.

2. A vacuum packaging apparatus as recited in claim 1, wherein said heating hood includes a plurality of heating elements connected to a power supply in series, each of said elements comprising a wire wrapped ceramic cone.

3. A vacuum packaging apparatus as recited in claim 1, wherein said sealing frame includes a bottom frame portion, and a top frame portion hingedly connected to said bottom frame portion.

4. A vacuum packaging apparatus as recited in claim 3, wherein said top frame portion is movable between an open position wherein said sheet of wrapping material may be positioned across said bottom frame portion, and a closed position wherein said sheet of wrapping material is held securely taut between said top frame portion and said bottom frame portion.

5. A vacuum packaging apparatus as recited in claim 1, further comprising mounting means juxtaposed with said base below said packaging table for mounting a roll of said wrapping material.

6. A vacuum packaging apparatus as recited in claim 1, wherein said packaging table and said frame are substantially rectangular and each of said table and said frame defines a first edge and a second edge opposite said first edge, and wherein said moving means includes a first elongated lift arm having a first end and a second end and a second elongated lift arm having a first end and a second end, a first pivot connected to said first end of said first elongated lift arm and to said base substantially adjacent said first edge of said packaging table, a second pivot connected to said first end of said second elongated lift arm and to said base substantially adjacent said second edge of said packaging table, a third pivot connected to said second end of said first elongated lift arm and to said first edge of said sealing frame, and a fourth pivot connected to said second end of said second elongated lift arm and to said second edge of said sealing frame.

7. A vacuum packaging apparatus as recited in claim 6, wherein said moving means further includes a cylinder mounted on said base and operatively associated with said lift arms for selectively moving said arms to selectively move said sealing frame.

8. A method of vacuum packaging, comprising the steps of:

providing a base having a stationary heating hood and a stationary packaging table distanced from and beneath said hood and located laterally outwardly therefrom and having a sealing frame movable along an arc between said heating hood and said packaging table, and a vacuum means;

placing a sheet of wrapping material in said sealing frame;

moving said sealing frame and sheet along said arc away from said packaging table to clear said packaging table, and into a heating position adjacent said stationary hood to heat said sheet;

placing a backing board onto said packaging table;

positioning a product on said backing board;

moving said sealing frame with said heated sheet onto said backing board;

applying a vacuum to said backing board to seal said sheet over said product; and removing said backing board from said packaging table.

9. An apparatus for vacuum packaging, which comprises:

stationary heating element means;

table means spaced beneath and laterally offset from said heating element means for unobstructively holding a backing board at a predetermined distance from said heating element means;

frame means for holding a sheet of wrapping material;

lift means operatively engaged with said frame means for moving said frame means along an arc between a heating position wherein said sheet is adjacent said stationary heating element means to heat said sheet, and a sealing position wherein said frame means is juxtaposed with said table means to place said heated sheet over said backing board; and vacuum means associated with said table means for drawing said heated sheet against said backing board to seal said sheet onto said backing board.

10. An apparatus for vacuum packaging as recited in claim 9, wherein said frame means includes a top frame portion hingedly connected to a bottom frame portion, and said table means is a packaging table mounted on a base.

11. An apparatus for vacuum packaging as recited in claim 10, wherein said heating element means is a heating hood having a plurality of heating elements connected to a power supply in series, each of said elements comprising a wire wrapped ceramic member.

12. A vacuum packaging apparatus as recited in claim 10, wherein said top frame portion is movable between an open position wherein said sheet of wrapping material may be positioned across said bottom frame portion, and a closed position wherein said sheet of wrapping material is held securely taut between said top frame portion and said bottom frame portion.

13. A vacuum packaging apparatus as recited in claim 10, further comprising mounting means juxtaposed With said table means for mounting a roll of said wrapping material.

14. A vacuum packaging apparatus as recited in claim 10, wherein said packaging table and said frame means are substantially rectangular and each of said table and said frame defines a first edge and a second edge opposite said first edge, and wherein said lift means includes a first elongated lift arm having a first end and a second end and a second elongated lift arm having a first end and a second end, a first pivot connected to said first end of said first elongated lift arm and to said base substantially adjacent said first edge of said packaging table, a second pivot connected to said first end of said second elongated lift arm and to said base substantially adjacent said second edge of said packaging table, a third pivot connected to said second end of said first elongated lift arm and to said first edge of said sealing frame, and a fourth pivot connected to said second end of said second elongated lift arm and to said second edge of said sealing frame.

15. A vacuum packaging apparatus as recited in claim 14, wherein said moving means further includes a cylinder mounted on said base and operatively associated with said lift arms for selectively moving said arms to selectively move said frame means.

* * * * *